US012790767B2

(12) United States Patent
Corn

(10) Patent No.: US 12,790,767 B2
(45) Date of Patent: Nov. 10, 2026

(54) YARN FILAMENT FOR ARTIFICIAL TURF AND METHOD FOR MAKING SAME

(71) Applicant: Columbia Insurance Company, Omaha, NE (US)

(72) Inventor: Joel Corn, Ringgold, GA (US)

(73) Assignee: Columbia Insurance Company, Omaha, NE (US)

( * ) Notice: Subject to any disclaimer, the term of this patent is extended or adjusted under 35 U.S.C. 154(b) by 488 days.

(21) Appl. No.: 17/707,216

(22) Filed: Mar. 29, 2022

(65) Prior Publication Data

US 2022/0220673 A1 Jul. 14, 2022

Related U.S. Application Data

(63) Continuation of application No. 13/951,133, filed on Jul. 25, 2013, now abandoned.

(60) Provisional application No. 61/675,676, filed on Jul. 25, 2012.

(51) Int. Cl.

| | |
|---|---|
| ***D02G 3/00*** | (2006.01) |
| ***D01D 5/253*** | (2006.01) |
| ***D02G 3/44*** | (2006.01) |
| ***E01C 13/08*** | (2006.01) |

(52) U.S. Cl.

CPC ..... *E01C 13/08* (2013.01); *D01D 5/253* (2013.01); *D02G 3/444* (2013.01); *D02G 3/445* (2013.01); *D10B 2505/202* (2013.01); *Y10T 428/2976* (2015.01)

(58) Field of Classification Search

CPC ..... E01C 13/08–083; E01C 2013/086; Y10T 428/2976; Y10T 442/3089; Y10T 442/609

USPC ..... 442/192, 335

See application file for complete search history.

(56) References Cited

U.S. PATENT DOCUMENTS

| | | | |
|---|---|---|---|
| 2,959,839 | A | 11/1960 | Raymond |
| 3,249,669 | A | 5/1966 | Jamieson |
| 3,621,087 | A | 11/1971 | Shimamura et al. |
| 3,914,488 | A | 10/1975 | Gorrafa |
| 4,054,709 | A | 10/1977 | Belitsin et al. |

(Continued)

FOREIGN PATENT DOCUMENTS

| | | | |
|---|---|---|---|
| DE | 19823926 | A1 | 12/1999 |
| GB | 1153543 | A | 5/1969 |

(Continued)

OTHER PUBLICATIONS

Office Action was issued on Oct. 9, 2019 by the Canadian Patent Office for CA Application No. 2822104, filed on Jul. 25, 2013 (Applicant—Shaw Industries Group, Inc,) (5 pages).

*Primary Examiner* — Marla D Mcconnell
*Assistant Examiner* — Kevin Worrell
(74) *Attorney, Agent, or Firm* — Fish & Richardson P.C.

(57) ABSTRACT

An artificial turf filament has a cross-section that includes a body having a center juncture having a first width and a first and second wing member arranged in diverging orientation from the center juncture. Each wing member having a plurality of legs and a plurality of leg junctures positioned between respective legs of the plurality of legs. Moving from the center juncture to a distal end of each wing member, the minimal cross-sectional widths of the respective legs of the plurality of legs decrease and the maximal cross-sectional widths of the respective leg junctures of the plurality of leg junctures decrease.

6 Claims, 3 Drawing Sheets

(56) References Cited

U.S. PATENT DOCUMENTS

| | | | | |
|---|---|---|---|---|
| 4,245,001 | A | 1/1981 | Phillips et al. | |
| 4,408,977 | A | 10/1983 | Phillips | |
| 4,472,477 | A | 9/1984 | Phillips | |
| 4,590,032 | A * | 5/1986 | Phillips | D01D 5/253 264/210.8 |
| 4,631,162 | A | 12/1986 | Yoshimoto et al. | |
| 4,634,625 | A | 1/1987 | Franklin | |
| 4,720,314 | A | 1/1988 | Black | |
| 4,791,026 | A | 12/1988 | Yoshimoto et al. | |
| 4,829,761 | A | 5/1989 | Phillips et al. | |
| 4,842,792 | A | 6/1989 | Baqrodia et al. | |
| 4,954,398 | A | 9/1990 | Baqrodia et al. | |
| 5,006,057 | A | 4/1991 | Bagrodia et al. | |
| 5,268,229 | A | 12/1993 | Phillips et al. | |
| 5,447,771 | A | 9/1995 | Mills et al. | |
| 5,591,523 | A | 1/1997 | Aneia | |
| 5,611,981 | A | 3/1997 | Phillips et al. | |
| 5,626,961 | A | 5/1997 | Aneia | |
| 5,736,243 | A | 4/1998 | Aneia | |
| 5,834,119 | A | 11/1998 | Roop | |
| 5,876,827 | A | 3/1999 | Fink et al. | |
| 6,147,017 | A | 11/2000 | Fastenau et al. | |
| 6,371,751 | B1 | 4/2002 | Aneia et al. | |
| 6,884,505 | B2 | 4/2005 | Shoemaker | |
| 7,018,946 | B2 | 3/2006 | Shoemaker | |
| 7,906,209 | B2 | 3/2011 | Hiqami et al. | |
| 2002/0034930 | A1 | 3/2002 | Yamazaki et al. | |
| 2004/0062903 | A1 | 4/2004 | Evans et al. | |
| 2008/0280093 | A1 | 11/2008 | Bieser et al. | |
| 2009/0162578 | A1 | 6/2009 | Van Balen et al. | |
| 2010/0297394 | A1 | 11/2010 | Peace | |
| 2011/0268933 | A1 | 11/2011 | Hahn et al. | |
| 2012/0114942 | A1 | 5/2012 | Emge | |
| 2013/0004683 | A1 * | 1/2013 | Auguste | E01C 13/08 428/397 |

FOREIGN PATENT DOCUMENTS

| | | |
|---|---|---|
| JP | H 08291424 | 11/1996 |
| JP | H 09132813 | 5/1997 |
| KR | P20000075669 | 12/2000 |
| KR | P20030011883 | 2/2003 |
| WO | WO 1998/038358 A1 | 9/1998 |
| WO | WO 2001/098565 A1 | 12/2001 |
| WO | WO 2010/128196 A1 | 11/2010 |

* cited by examiner

YARN FILAMENT FOR ARTIFICIAL TURF AND METHOD FOR MAKING SAME

CROSS REFERENCE TO RELATED APPLICATION

This application is a continuation of U.S. patent application Ser. No. 13/951,133, filed Jul. 25, 2013, which claims the benefit of priority to U.S. Provisional Application No. 61/675,676, filed on Jul. 25, 2012. The entire disclosures of these applications are hereby incorporated by reference herein for all purposes.

FIELD OF THE INVENTION

The invention relates in general to an improved synthetic turf which simulates grass for both indoor and outdoor use as a landscape, recreational and sports surface. More particularly, this invention relates to an improved filament for making such synthetic turf which provides increased resilience and glare reduction.

BACKGROUND OF THE INVENTION

Simulated-grass carpeting or synthetic turf for landscape and recreational uses such as football, baseball, soccer and field hockey is well known. Conventional synthetic turf surfaces generally include a weather-resistant, cushioned backing, or pad, onto which is adhesively joined a fabric backing, or substrate. Typically, artificial turf comprises a plurality of relatively heavy denier synthetic upwardly extending polymer filaments simulating grass which are anchored into the fabric backing or substrate and from which extend a plurality of relatively heavy denier synthetic polymer filaments simulating grass. These synthetic turfs are typically produced by conventional weaving, knitting or tufting operations employing either a single filament, a package of filaments, or a yarn of twisted or braided filaments. Sand as a filler for stabilization of the turf, and or elastic material to endow the formed artificial turf with a desired degree of elasticity can be added between the pile yarns.

Conventional synthetic turf filaments are typically uniformly manufactured having substantially rectangular, rounded, oval, triangular, rhombus, diamond, or V or U-shaped cross-sections. Many of the noted conventional cross-sectional shapes have large portions of their respective cross-sectional contours that are generally flat or only slightly concave or convex. Resultingly, at certain external viewer viewing angles, a specular reflection from these fiber surfaces creates a shiny appearance on the turf filaments that is objectionable to many external viewers. By the term "glare," is meant that the specks of light perceived by an external viewer on the filaments when a light source is directed at the filament. This is due to the minute filament sections acting as mirrors or reflecting prisms. The term "glare" should not be confused with the term "luster," which is meant the overall glow of the fiber from reflected light. One skilled in the art will appreciate that a filament can conventionally be referred to as having a bright or dull luster, but may or may not have a high degree of spectral reflection or "glare."

Conventional synthetic turf filaments are typically manufactured by an extrusion process from polymers such as polyamides, polyesters, polyethylene and polypropylene. It is also known to roughen, rib, treat with surfactants, texturize or otherwise treat the synthetic turf filaments to facilitate fabrication and prevent footwear slippage. Finally, it is also known to striate or score exterior portions of synthetic turf filaments to reduce glare or sheen.

SUMMARY

This invention relates to synthetic filaments having a bi-wing cross-section with each wing member having a plurality of legs connected by leg junctures. Thus, in one exemplary aspect, the contour of each wing member can comprise a plurality of convex and concave curves connected by substantially planar legs along the contour or peripheral edge, in cross-section, of each wing member. In one aspect and in cross-section, each wing member has three curvatures on each of a top and bottom side of the filament, and the filaments have an aspect ratio of between about 4.3 to 4.9, and preferably about 4.6.

Exemplary suitable synthetic polymers comprise polyamides, such as nylon 66 and nylon 6, polyesters, such as polyethylene terephthalate and polytrimethylene terephthalate, polyolefins, such as polyethylene and polypropylene, and polyacrylonitrile. Preferably, polyethylene is used. In optional aspects, the filaments can be in the form of a continuous filament yarn and a crimped continuous filament yarn.

Accordingly, there is a need in the pertinent art for a filament for an artificial turf product that addresses the issues discussed above. More particularly, there is a need in the pertinent art for a filament that can be used to form artificial turf products that exhibit low specular reflection, high resilience, and resistance to fibrillation.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DETAILED DESCRIPTION

Figure 1:
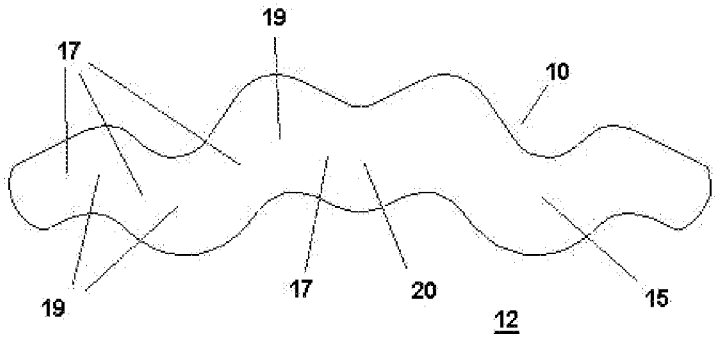
FIG. 1 illustrates a top view of a spinneret capillary, comprising a spinneret orifice that defines intersecting quadrilaterals in connected series with the respective junctures of the intersecting quadrilaterals. The respective juncture being greater in width than the width of the adjoining defined quadrilaterals. The juncture of the two intersecting quadrilaterals at a center of the spinneret orifice defining a center juncture section and the remaining quadrilaterals defining a pair of opposed wing member sections.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a leg" can include two or more such legs unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The present invention may be understood more readily by reference to the following detailed description of the invention and the examples included therein and to the Figures and their previous and following description.

The filaments 2 of this invention are generally prepared by conventional spinning molten polymer or polymer solutions through spinneret capillaries which are designed to provide the desired bi-wing cross-section of the filament. In optional aspects, it is contemplated that the filaments can be formed from synthetic, thermoplastic polymers that are melt-spinnable. These polymers can comprise, for example and without limitation, polyolefins such as polyethylene and polypropylene, polyamides such as polyhexamethylenediamine adipamide (nylon 66) and polycaprolactam (nylon 6), and polyesters such as polyethylene terephthalate and polytrimethylene terephthalate As one skilled in the art will appreciate, copolymers, terpolymers, and melt blends of such polymers are also suitable. Polymers that form solutions, such as polyacrylonitrile, can also be optionally used. These polymer solutions can be conventionally dry-spun into filaments having the desired cross-section.

Generally, in a conventional melt spinning process, the molten polymer is extruded into air or other gas, or into a suitable liquid, where it is cooled and solidified. In another conventional aspect, suitable quenching gasses and liquids can include, for example and without limitation, air at room temperature, chilled air, and water. In another aspect, and in a conventional dry spinning process, the polymer solution can be extruded as a continuous stream into a heated chamber to remove the solvent and to thereby form a solid filament. It is recognized that the specific spinning conditions, e.g., viscosity, rate of extrusion, quenching, etc. will vary depending upon the polymer used. In an optional aspect, it is contemplated that the polymer spinning dopes may also contain conventional additives, such as antioxidants, dyes, pigments, antistatic agents, ultraviolet (UV) stabilizers, and the like.

Figure 2:
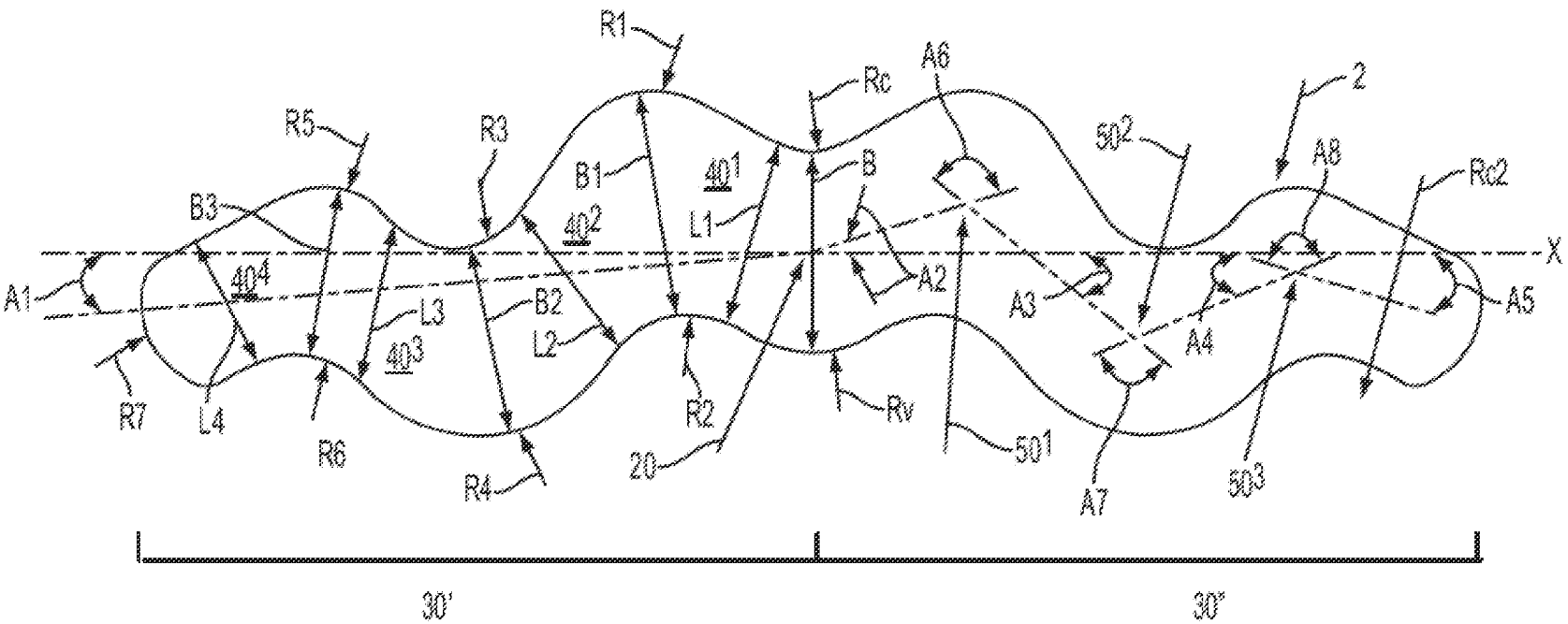
FIG. 2 is an enlarged top view of the spinneret capillary of the type shown in FIG. 1.

Referring to FIGS. 1 and 2, an example of a suitable spinneret capillary 10 for forming the filaments of this invention is illustrated. In this example, a spinneret orifice 15 is defined in a planar member 12 that is suitable for melt spinning a filament-forming polymeric material therethrough. In one aspect, the spinneret orifice 15 defines intersecting quadrilaterals 17 in connected series with the respective junctures 19 of the intersecting quadrilaterals being greater in width than the width of the adjoining defined quadrilaterals, with the juncture of the two intersecting quadrilaterals at a center of the spinneret orifice defining a center juncture section 20 and with the remaining quadrilaterals defining a pair of opposed wing member sections 30.

As shown, the center juncture section 20 of the spinneret orifice 15 has a first width B. In another aspect, the spinneret orifice has a cross-sectional axis X that bisects and is transverse to the first width. In another aspect, the first wing member section 30' and the second wing member section 30" are arranged in diverging orientation from the center junction section 20. In one aspect, each respective wing member section 30 extends outwardly and generally downwardly therefrom the center juncture section at an angle A1 relative to the spinneret orifice cross-sectional axis of between about 3° to about 30°.

In a further aspect, each quadrilateral 17 of the respective wing member section forms a leg section 40 and the connecting junctures 19 are positioned between and connect the respective adjoining leg sections. In another aspect, each of the wing member sections comprises a plurality of leg sections 40 and a plurality of connecting leg juncture sections 50. In a further aspect, moving from the center juncture section to a distal end of the wing member section of the spinneret orifice, the minimal cross-sectional widths of the respective leg sections 40 of the plurality of leg sections decrease and the maximal cross-sectional widths of the respective leg juncture sections 50 of the plurality of leg junctures decreases. In one aspect, it is contemplated that both of the wing member sections are substantially identical.

As shown in more detail in FIG. 2, it is contemplated that the plurality of leg sections 40 can comprise a first leg section $\mathbf{40}^1$, a second leg section $\mathbf{40}^2$, a third leg section $\mathbf{40}^3$, and a fourth leg section $\mathbf{40}^4$. Similarly, in another aspect, it is contemplated that the plurality of leg juncture sections 50 can comprise a first leg juncture section $\mathbf{50}^1$ positioned between the respective first and second leg sections, a second leg juncture section $\mathbf{50}^2$ positioned between the respective second and third leg sections, and a third leg juncture section $\mathbf{50}^3$ positioned between the respective third and fourth leg sections.

In one aspect, the minimal cross-sectional width L1 of the first leg section $\mathbf{40}^1$ can be less than the first width B of the center juncture section. In other aspects, the maximal cross-sectional width B1 of the first leg juncture section 50$^1$ can be greater than the minimal cross-sectional widths of the first leg section and the second leg section L1, L2 and the maximal cross-sectional width B1 of the first leg juncture 50$^1$ can be greater than the first width B of the center juncture section. In additional aspects, it is contemplated that the maximal cross-sectional width B2 of the second leg juncture section 50$^2$ can be greater than the minimal cross-sectional widths of the second leg section 40$^2$ and the third leg section L2, L3 and the maximal cross-sectional width B2 of the second leg juncture section 50$^2$ can be less than the maximal cross-sectional width B1 of the first leg juncture section. In a further aspect, the maximal cross-sectional width B3 of the third leg juncture section 50$^3$ is greater than the minimal cross-sectional widths of the third leg section 40$^3$ and the fourth leg section L3, L4, and the maximal cross-sectional width of the third leg juncture section B3 is less than the maximal cross-sectional width B2 of the second leg juncture section 50$^2$.

In an additional aspect, the peripheral edge of the center juncture section of the spinneret orifice defines a central concave curve section Rc on the top surface of the face of the spinneret orifice and a central convex curve section Rv located on the bottom surface of the spinneret orifice, which is positioned generally opposite the central convex curve section. In another aspect, each wing member section has, along the peripheral edge of the top face of the wing member section, two or more leg curved sections that alternate in order of convex to concave with the first-mentioned leg convex curve section of the wing member section positioned adjacent the one central concave curve section on the top surface of the spinneret orifice. In this aspect, along the peripheral edge of the bottom surface of the wing member section, two or more leg curve sections that alternate in order of concave to convex with the first-mentioned leg concave curve section of the wing member being positioned adjacent the one central convex curve section on the bottom surface of the spinneret orifice.

In one exemplary embodiment, the two or more leg curve sections on the top surface of each wing member section can comprise, moving toward the distal end of the wing member section, a first top convex curve section R1, a second top concave curve section R3, and a third top convex curve section R5. In this exemplary aspect, the two or more leg curve sections on the bottom surface of each wing member section can comprises, moving toward the distal end of the wing member section, a first bottom concave curve section R2, a second bottom convex curve section R4, and a third bottom concave curve section R6.

In one aspect, the peripheral edge of each leg juncture section of the spinneret orifice can define a radius of concave curvature on one face of the wing member section and a generally radius of convex curvature located on the other face of the wing member section generally opposite said radius of concave curvature. In one aspect, the radius of concave curvature of the second top concave curve section R3 can be less than the radius of concave curvature of any of the other concave curves sections of each wing member section. In a further aspect, it is contemplated that the radius of concave curvature of the second top concave curve section R3 can be greater than central concave curve section Rc and the less than the radius of concave curvature of any of the other concave curves sections of each wing member section, e.g., R2 and R6.

In another aspect, the radius of concave curvature of the central concave curve section Rc can be less than the radius of concave curvature of any of the concave curve sections of each wing member section. In an optional aspect, a portion of the top surface of the wing member section proximate the second top concave curve section of each of the respective first and second wing member section can be positioned adjacent or tangent to the spinneret orifice cross-sectional axis.

In an additional aspect, the first leg section 40$^1$ of each wing member section 30', 30" can extend outwardly and generally upwardly therefrom the center juncture section at an angle A2 relative to the spinneret orifice cross-sectional axis of between about 5° to about 30°. Similarly, the second leg section 40$^2$ of each wing member section can extend outwardly and generally downwardly therefrom the first leg juncture section at an angle A3 relative to the spinneret orifice cross-sectional axis of between about 5° to about 60°. In a further aspect, the third leg section 40$^3$ of each wing member section extends outwardly and generally upwardly therefrom the second leg juncture at an angle A4 relative to the spinneret orifice cross-sectional axis of between about 5° to about 40° and finally, the fourth leg section 40$^4$ of each wing member section can extend outwardly and generally downwardly therefrom the third leg juncture at an angle A5 relative to the spinneret orifice cross-sectional axis of between about 5° to about 40°.

As one skilled in the art will appreciate, a filament 2 formed via passage through an exemplary spinneret orifice shown in FIGS. 1 and 2 will have a similar shape as the defined orifice but with expansions in relative dimensions. Thus, in describing the formed filament, similar conventions with respect to widths and angles are used for ease in understanding the nature of the invention.

Figure 3:
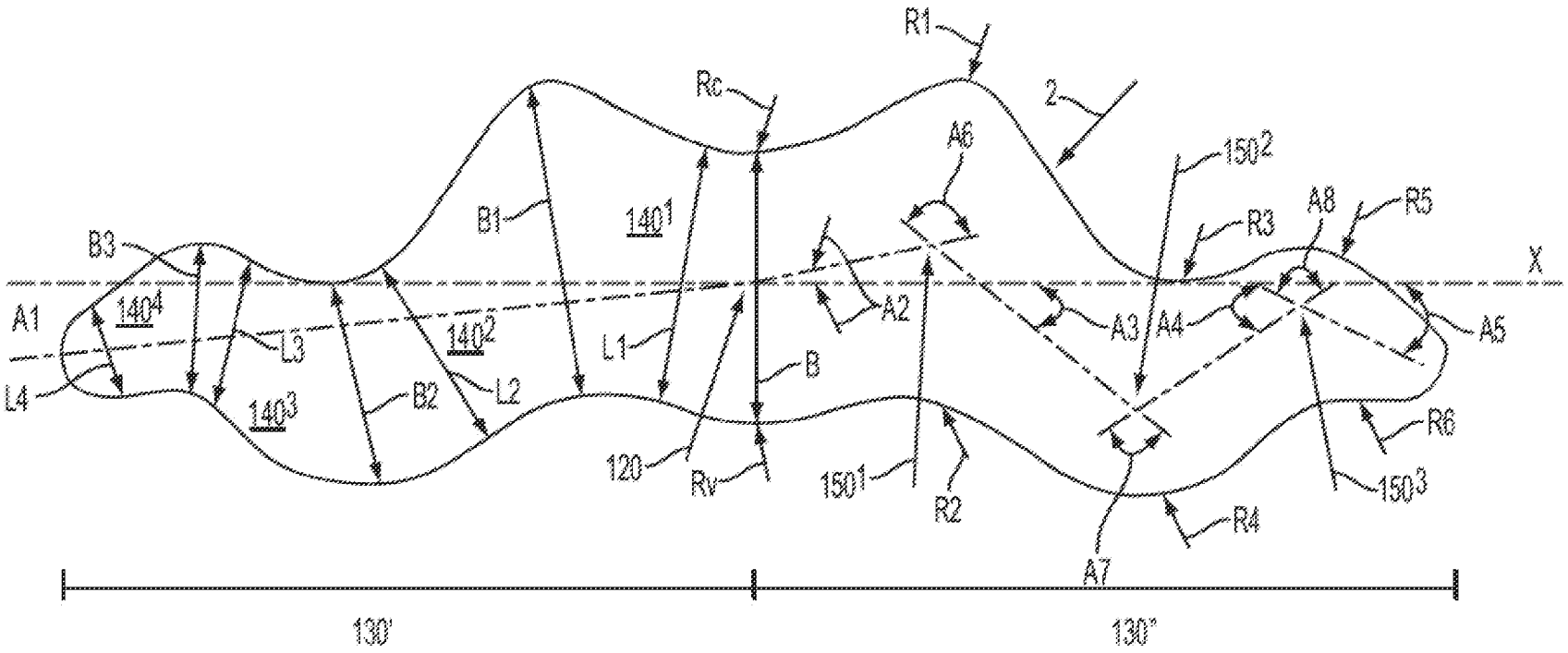
FIG. 3 is a cross-sectional view of a filament spun through a spinneret capillary of the type shown in FIG. 1.

In one aspect, it is contemplated that the formed filament 2 will have a body having an exterior surface defining a peripheral edge and in cross-section. Referring to FIG. 3, in cross-section, the body will also have a center juncture 120 having a first width B and a body cross-sectional axis that substantially bisects and is transverse to the first width. The body will also have a first and second opposed wing member 130', 130", each wing member having opposing top and bottom faces In one aspect, the respective first and second wing members 130', 130" can be arranged in diverging orientation from the center juncture 120 and can extend outwardly and generally downwardly therefrom the center juncture at an angle A1 relative to the body cross-sectional axis of between about 1° to about 30°. In one exemplary aspect, each wing member of the body is substantially identical in shape.

In a further aspect, each wing member 130', 130" can comprise a plurality of legs 140 and a plurality of leg junctures 150. As one skilled in the art will appreciate, each leg juncture of the plurality of leg junctures is positioned between respective adjoining legs of the plurality of legs. In an additional aspect, moving from the center juncture 120 to a distal end of each wing member, the minimal cross-sectional widths of the respective legs of the plurality of legs can decrease and the maximal cross-sectional widths of the respective leg junctures of the plurality of leg junctures can also decrease.

In one aspect, the plurality of legs 140 on each wing member can comprise a first leg 140$^1$, a second leg 140$^2$, a third leg 140$^3$, and a fourth leg 140$^4$, and the plurality of leg junctures 150 on each wing member can comprise a first leg juncture 150$^1$ positioned between the respective first and second legs, a second leg juncture 150$^2$ positioned between the respective second and third legs, and a third leg juncture 150$^3$ positioned between the respective third and fourth legs.

In various aspects, the minimal cross-sectional width L1 of the first leg 140$^1$ is less than the first width B of the center juncture. In another aspect, the maximal cross-sectional width B1 of the first leg juncture can be greater than the minimal cross-sectional widths of the first leg and the second leg L1, L2, and wherein the maximal cross-sectional width B1 of the first leg juncture can be greater than the first width B of the center juncture.

In an additional aspect, it is contemplated that the maximal cross-sectional width B2 of the second leg juncture can be greater than the minimal cross-sectional widths of the second leg and the third leg L2, L3 and the maximal cross-sectional width B2 of the second leg juncture can be less than the maximal cross-sectional width B1 of the first leg juncture. It is also contemplated that the maximal cross-sectional width B3 of the third leg juncture can be greater than the minimal cross-sectional widths of the third leg and the fourth leg L3, L4 and the maximal cross-sectional width B3 of the third leg juncture can be less than the maximal cross-sectional width B2 of the second leg juncture.

In one aspect, in cross-sectional, the peripheral edge or contour of the center juncture 120 of the body of the filament 2 can define a central concave curve Rc on the top face of the body and a central convex curve Rv located on the bottom face of the body generally opposite the central convex curve. In an additional aspect, each wing member of the filament can have, along the peripheral edge of the top face of the wing member, two or more leg curves that alternate in order of convex to concave with the first-mentioned leg convex curve of the wing member being positioned adjacent the one central concave curve on the top face of the body. Each wing member can also have, along the peripheral edge of the bottom face of the wing member, two or more leg curves that alternate in order of concave to convex with the first-mentioned leg concave curve of the wing member being positioned adjacent the one central convex curve on the bottom face of the body.

The peripheral edge of each leg juncture of the body of the filament can define, in cross-section, a radius of concave curvature on one face of the wing member and a generally radius of convex curvature located on the other face of the wing member generally opposite said radius of concave curvature.

In this aspect, the two or more leg curves on the top face of each wing member can comprise, in cross-section moving toward the distal end of the wing member, a first top convex curve R1, a second top concave curve R3, and a third top convex curve R5. In a similar aspect, the two or more leg curves on the bottom face of each wing member can comprise, in cross-section moving toward the distal end of the wing member, a first bottom concave curve R2, a second bottom convex curve R4, and a third bottom concave curve R6.

In one aspect, the radius of concave curvature of the second top concave curve R3 can be less than the radius of concave curvature of any of the other concave curves of each wing member R2 and R6. In another aspect, the radius of concave curvature of the central concave curve Rc can be greater than the radius of concave curvature of any of the concave curves of each wing member. In an additional aspect, the peripheral edge of the top face of the wing member proximate the second top concave curve R3 of each of the wing members can be positioned adjacent and substantially tangent to the body cross-sectional axis.

In cross-section, the first leg 140$^1$ of each wing member can extend outwardly and generally upwardly therefrom the center juncture 120 at an angle A2 relative to the body cross-sectional axis of between about 5° to about 30°. Similarly, the second leg 140$^2$ of each wing member can extend outwardly and generally downwardly therefrom the first leg juncture 150$^1$ at an angle A3 relative to the body cross-sectional axis of between about 5° to about 60°. In another aspect, the third leg 140$^3$ of each wing member can extend outwardly and generally upwardly therefrom the second leg juncture 150$^2$ at an angle A4 relative to the body cross-sectional axis of between about 5° to about 40°. Optionally, the fourth leg 140$^4$ of each wing member can extend outwardly and generally downwardly therefrom the third leg juncture 150$^3$ at an angle A5 relative to the body cross-sectional axis of between about 5° to about 40°.

In a further aspect, the elongate cross-sectional length of the second leg 140$^2$ of the formed filament can be greater than the elongate cross-sectional length of any of the other legs for each wing member. Optionally, the elongate cross-sectional length of the first leg 140$^1$ of the formed filament can be substantially the same as the elongate cross-sectional length of the third leg 140$^3$. In another optional aspect, it is contemplated that the elongate cross-sectional length of the third leg 140$^3$ can be greater than the elongate length of each of the first and fourth legs 140$^1$ and 140$^4$, for each wing member of the formed filament.

In a further aspect, it is contemplated that the formed filament 2 will further comprise means for reducing specular reflection from the exterior surface of the filament. In one aspect, the means for reducing specular reflection from the exterior surface of the filament can comprise orienting the peripheral cross-sectional edge of each of the respective first, second, third and fourth legs on the top face of each wing member of the filament at different angles with respect to the body cross-sectional axis to reduce specular reflection to an external viewer at any selected viewing angle. In another aspect, the means for reducing specular reflection from the exterior surface of the filament can also comprise orienting the peripheral cross-sectional edge of each of the respective first, second, third and fourth legs on the bottom face of each wing member of the filament at different angles with respect to the body cross-sectional axis to reduce specular reflection to an external viewer. In a further aspect, it is contemplated that the means for reducing specular reflection from the exterior surface of the filament can comprise orienting the peripheral cross-sectional edge of each of the respective first, second, third and fourth legs on both the top and bottom faces of each wing member of the filament at different angles with respect to the body cross-sectional axis to reduce specular reflection to an external viewer at any selected viewing angle.

In various aspects, it is contemplated that yarn comprising the filaments described herein would be characterized by a denier of about 1800 or more. The yarn comprising the filaments described herein can have a tenacity of about 1.3 grams per denier or more, preferably about 1.5 grams per denier or more, and more preferably about 1.7 grams per denier or more. In one example, the tenacity can be about 1.79 grams per denier. In another aspect, the yarn comprising the filaments described herein can have an elongation of about 70 percent or more, preferably about 75 percent or more, and more preferably about 80 percent or more. In one example, the elongation can be about 82 percent. In a further aspect, the yarn comprising the filaments described herein can have a modulus of about 4 grams per denier or more, preferably about 4.2 grams per denier or more, and more preferably about 4.4 grams per denier or more. In one example, the modulus can be about 4.5 grams per denier. In one aspect, the yarn comprising the filaments described herein can have a specific volume in cubic centimeters per gram at one tenth gram per denier tension of about 1.0 to about 1.1.

It is contemplated that the filaments described herein can be used to form an artificial turf product. Conventionally, artificial turf is placed on a stabilization and drainage layer and the artificial turf product is of a carpet like structure that can include a backing layer, a substrate coupled to and overlying the backing layer and a plurality of turf filaments (of the type described herein), which can be tufted or otherwise adhered onto the substrate. Optionally, a layer of filling material, such as, for example and without limitation, sand, rubber, or polymeric particles, or mixtures thereof, is also applied to the surface of the substrate so that the top portions of the turf filaments extend outwardly above the surface of the layer of filling material.

In one aspect, an exemplary process for melt spinning an artificial turf filament as described above can comprise initially melt spinning a filament-forming polymeric material through a spinneret orifice as shown in FIGS. 1 and 2 to form the filament having the general shape shown in FIG. 3. Subsequently, the formed filament can be quenched at a rate sufficient to maintain at the desired geometry of the spun filament and the quenched filament can be taken up under tension.

In one aspect, a yarn comprising the filaments described herein can yield a more rigid fiber at the same fiber denier. Thus, the yarn comprising the filaments described herein will generally resist being bent when a ball rolls across a surface of an artificial turf product formed from the filaments described herein. It is contemplated that the energy required from the ball to overcome resistance offered by the filaments described herein leaves less kinetic energy in the ball and the ball comes to rest more quickly when compared to ball roll testing on turf made with a less rigid fiber, i.e., more energy is required to roll a ball a given distance over an artificial turf product formed from the filaments described herein then is required to roll a ball over the given distance on a conventional artificial turf product.

EXAMPLE

To test the energy absorption qualities of a surface of an artificial turf product formed from the rigid filaments described herein, ball roll testing was conducted on two installed artificial turf fields. One of the artificial turf fields has turf made with the rigid filaments described herein and the other artificial turf field has turf made with a conventional artificial fiber.

The ball roll was conducted by rolling a soccer ball down a 45° ramp from a height of 1 meter. The distance from the point at the end of the ramp where the ball first contacts the turf to the location where the ball stops rolling was measured. Five repetitions are made. The ball roll was measured across in four directions, two generally along the machine direction of the artificial turf and two across the width (transverse to the machine direction) of the artificial turf. The data was averaged to get the average ball roll.

The ball roll data for the two artificial turf fields is shown below.

Field Installed with Turf Having Bolt Fiber

| | 1 | 2 | 3 | 4 | 5 | Avg (ft) | Avg (M) |
|---|---|---|---|---|---|---|---|
| North | 25.4 | 25.3 | 25.5 | 29.9 | 30.3 | 24.3 | 7.4 |
| South | 23.0 | 23.2 | 23.1 | 24.4 | 25.5 | 23.9 | 7.3 |
| East | 21.3 | 24.4 | 25.1 | 24 | 23.9 | 24.3 | 7.4 |
| West | 22.9 | 22.9 | 23.8 | 24.0 | 24.1 | 23.6 | 7.2 |
| | | | | | | | Avg = 7.3M |

Field Installed with Turf Having Standard Fiber

| | 1 | 2 | 3 | 4 | 5 | Avg (ft) | Avg (M) |
|---|---|---|---|---|---|---|---|
| North | 35.3 | 37.9 | 34.4 | 36.4 | 35.7 | 35.9 | 10.9 |
| South | 32.1 | 31.3 | 34.6 | 33.8 | 32.6 | 32.9 | 10.0 |
| East | 34.8 | 32.5 | 32.9 | 33.7 | 36.1 | 34.0 | 10.4 |
| West | 31.2 | 33.5 | 33.9 | 33.9 | 34.9 | 33.5 | 10.4 |
| | | | | | | | Avg = 10.4M |

The average ball roll for the field made with rigid filaments described herein is 30% less than the average ball roll for the turf made with conventional artificial fiber. Of importance from a commercial standpoint, the value of 7.3 M for the field with rigid filaments described herein would pass the FIFA 2 STAR requirements while the value of 10.4 M for the field with conventional artificial fiber would not meet either the FIFA 1 STAR or FIFA 2 STAR requirements.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims

What is claimed is:

1. A filament comprising:

a body having a peripheral edge and an exterior surface, comprising, in cross-section:

a top face;

a bottom face opposite from the top face along a first axis;

a center juncture having a first width along the first axis, wherein:

the body has a second axis transverse to the first axis, and the peripheral edge of the cross-section at the center juncture defines a central concave curve on the top face and a central convex curve on the bottom face; and two wing members, a first wing member of the two wing members extending in a first direction from the center juncture towards a distal end of the first wing member along the second axis, a second wing member of the two wing members extending in a second direction opposite from the first direction, the first wing member comprising:

a plurality of legs; and a plurality of leg junctures connecting respective legs of the plurality of legs, wherein, moving from the center juncture to the distal end of the first wing member, maximal cross-sectional widths of the leg junctures of the plurality of leg junctures decrease, wherein the first wing member is defined by the top and bottom faces, wherein the plurality of legs comprises a first leg, a second leg, a third leg, and a fourth leg, and wherein the plurality of leg junctures comprises a first leg juncture positioned between the respective first and second legs, a second leg juncture positioned between the respective second and third legs, the second leg juncture being separated from the center juncture by the first leg juncture, a maximal cross-sectional width of the first leg juncture being greater than the first width of the center juncture, and a third leg juncture positioned between the respective third and fourth legs, the peripheral edge of the body defining a plurality of top curves and a plurality of bottom curves, including, at each leg juncture of the plurality of leg junctures, a respective top curve of the plurality of top curves at the top face and a respective bottom curve of the plurality of bottom curves at the bottom face, and the plurality of bottom curves alternating in order of concave to convex in the first direction from the center juncture, the plurality of bottom curves including:

a first bottom curve at the first leg juncture that is concave and positioned adjacent the central convex curve on the bottom face, a second bottom curve at the second leg juncture that is convex and positioned adjacent the first bottom curve, and a third bottom curve at the third leg juncture that is concave and positioned adjacent the second bottom curve, wherein a bottommost surface of the first wing member along the first axis comprises the second bottom curve, and wherein a bottommost edge of the central convex curve is offset along the first axis from the bottommost surface of the first wing member such that a distance along the first axis between the bottommost edge of the central convex curve and the central concave curve on the top face is less than a distance along the first axis between the bottommost surface of the first wing member and the central concave curve on the top face.

2. The filament of claim 1, wherein, in cross-section, each wing member has, along the top face, top curves alternating in order of convex to concave with a first top curve of the wing member being convex and positioned adjacent the central concave curve on the top face.

3. The filament of claim 1, wherein, in cross-section, the peripheral edge of each leg juncture defines:

a radius of concave curvature on the top face or the bottom face; and a radius of convex curvature on an opposite face from the radius of concave curvature.

4. The filament of claim 1, wherein:

an upward direction is defined from the bottom face towards the top face along the first axis, a downward direction is defined from the top face towards the bottom face along the first axis, an outward direction is defined from the center juncture towards the distal ends of the wing members along the second axis, and in cross-section:

the first leg of the first wing member extends outwardly and generally upwardly therefrom the center juncture;

the second leg of the first wing member extends outwardly and generally downwardly therefrom the first leg juncture;

the third leg of the first wing member extends outwardly and generally upwardly therefrom the second leg juncture; and the fourth leg of the first wing member extends outwardly and generally downwardly therefrom the third leg juncture.

5. The filament of claim 1, wherein, for each wing member, the distal end of the wing member is offset along the first axis from the bottommost surface of the wing member such that the distance along the first axis between the bottommost surface of the wing member and the central concave curve on the top face is greater than a distance along the first axis between the distal end of the wing member and the central concave curve on the top face.

6. The filament of claim 1, wherein the bottommost surface of each of the two wing members comprise bottommost surfaces of the body along the first axis.

* * * * *